United States Patent [19]

Hsieh et al.

[11] Patent Number: 5,035,970

[45] Date of Patent: Jul. 30, 1991

[54] ENCAPSULATED TONER COMPOSITIONS AND PROCESSES THEREOF

[75] Inventors: Bing R. Hsieh, Webster; Robert J. Gruber, Pittsford, both of N.Y.; Karen A. Moffat, Brantford, Canada; Walter Mychajlowskij, Georgetown, Canada; Anthony J. Paine, Mississauga, Canada

[73] Assignee: Xerox Corporation, Stamford, Conn.

[21] Appl. No.: 416,071

[22] Filed: Oct. 2, 1989

[51] Int. Cl.[5] ..... G03C 1/72; G03G 5/00; G03G 9/00

[52] U.S. Cl. ..... 430/109; 430/137; 430/138

[58] Field of Search ..... 430/138, 109, 137

[56] References Cited

U.S. PATENT DOCUMENTS

| | | | |
|---|---|---|---|
| 4,049,447 | 9/1977 | Azar et al. | 96/15 D |
| 4,307,169 | 12/1981 | Matkan | 430/138 X |
| 4,518,547 | 5/1985 | Cuff et al. | 424/497 X |
| 4,557,991 | 12/1985 | Takagiwa et al. | 430/109 |
| 4,699,866 | 10/1989 | Naoi et al. | 430/138 |
| 4,758,506 | 7/1988 | Lok et al. | 430/903 |
| 4,774,160 | 9/1988 | Mahabadi et al. | 430/106 |
| 4,777,233 | 10/1988 | Suzuki et al. | 528/32 |
| 4,855,209 | 8/1989 | Martin et al. | 430/137 |
| 4,904,502 | 2/1990 | Yusa et al. | 430/138 |

*Primary Examiner*—John Goodrow
*Assistant Examiner*—S. Crossan
*Attorney, Agent, or Firm*—E. O. Palazzo

[57] ABSTRACT

An encapsulated toner composition comprised of a core comprised of pigments or dyes, and a polymer; and wherein the core is encapsulated in a polyester shell with functional groups thereon, and derived from diacid halide polyesters.

38 Claims, No Drawings

ENCAPSULATED TONER COMPOSITIONS AND PROCESSES THEREOF

BACKGROUND OF THE INVENTION

The present invention is generally directed to toner compositions, and more specifically to encapsulated toner compositions. In one embodiment the present invention is related to heat fusible encapsulated toner compositions comprised of a core containing pigments or dyes, and wherein the core is encapsulated in certain modified polyesters, especially amorphous polyesters derived from reactive or telechelic polyesters. Also, the present invention is directed to an economical and flexible process for the in situ formation of telechelic polyesters which can then be transformed to the modified polyester shell components having various desirable thermal, triboelectrical and morphological properties. More specifically, the shell formation process of the present invention in one embodiment is directed to a two stage interfacial condensation polymerization which can be adapted for the preparation of amorphous, liquid crystalline and semicrystalline polyesters or polyarylates with various specific chain ends, molecular weights and structures such as block and branched polyesters. Also, with the present invention toner particles of an average volume diameter of from, for example, 5 to about 30 microns with narrow size distributions of from, for example, about 1.3 to 1.8 can be obtained, and classification is eliminated. Further, there is provided with the present invention a process for the preparation of various colored toners from laboratory scale (less than 1.0 kilogram) to large scale toner production (up to several hundred kilograms). Another specific embodiment of the present invention relates to encapsulated toner compositions comprised of a core containing polymer binders, and dye or pigment particles, which core is encapsulated by modified polyester shells. Advantages associated with the toner compositions of the present invention include the elimination and/or the minimization of image ghosting; excellent toner fixing characteristics; superior surface release properties enabling their selection, for example, in imaging and printing systems wherein a release fluid such as a silicone oil is avoided; substantially no blocking or agglomeration of toner particles; excellent toner powder flow characteristics without surface additives; no leaching of the core components or complete encapsulation; low processing costs, heat fusing characteristics and properties that approximate those of the conventional toner compositions; and the capability for lower melting core materials, controlling and altering the weight average and number average molecular weight of the shell polymers and the structures thereof by, for example, selecting various end capping components thereby providing, for example, acceptable surface properties including desirable charging characteristics, excellent flowing toners, hydrophobicity of the toner particles, and the like; complete shell formation wherein contamination is avoided and/or minimized; and encapsulated toners, which evidence a high degree or percentage of pigment dispersion. Also, and more specifically, the toner compositions of the present invention possess core melting temperatures as low as 50° C. and shell weight percent as low as 5 percent, permit a life extension of the fuser roll incorporated into, for example, electrostatographic, especially xerographic, imaging processes in that, for example, lower fusing energies can be selected, that is fusing can be affected at temperatures not exceeding 140° C. in many embodiments. One of the primary purposes of encapsulation for the toners of the present invention is to passivate the pigment charging, that is the charging characteristics of the toner particles are ultimately controlled by that of the colorants, especially those exposed at the surfaces of the toner particles. Influence of the pigment charging can be prevented by encapsulation of various color particles with a common shell modified polyester polymer of the desired charging properties. Thus, for example, the toner compositions of the present invention can be charged positively or negatively in a narrow tribo range of less than 10 microcoulombs per gram, and preferably below 5 microcoulombs per gram, irrespective of the pigment type selected for the core. Therefore, developer charging, including triboelectric and admix characteristics, can be controlled and preselected with the process of the present invention, including the use of a surface additive in conjunction with appropriate carrier particles. Moreover, the toner particles obtained by the process of the present invention are environmentally stable due partly to the hydrophobicity of the polyester shells, and homogeneous or high degree of pigment dispersion without agglomerated pigment particles within the core. As a result, images with high color chroma and high transparency projection efficency can be achieved with the toners of the present invention.

The toner compositions of the present invention can be selected for a variety of known reprographic imaging and printing processes including electrophotographic and ion printing (ionography) processes. They can also be utilized in electrophotographic copying and printing apparatus wherein the transfer of developed images onto paper is executed electrostatically, and the subsequent fixing of transferred images is accomplished by application of pressure, thermal energy or a combination of pressure and thermal energy. The toner compositions of the present invention provide excellent surface release characteristics, and the use of lubricating silicone oils or other surface release fluids to prevent image offset to the pressure roll and hot roll fuser can be avoided.

The toner compositions of the present invention can in one specific embodiment be prepared by first mixing colorants, preformed core resins, a mixture of core monomer liquids, oil-soluble shell monomers, free radical polymerization initiators, and additives such as plasticizers, pigment dispersants and chain transfer agents to provide a pigment dispersion mixture; dispersing the pigment dispersion into an aqueous emulsifier or stabilizer solution containing a phase transfer catalyst under high shear to yield a suspension of pigmented droplets; adding an aqueous solution of water-soluble shell monomers to the resulting suspension to react with the oil-soluble shell monomers to form a reactive polyester shell around the droplets; adding another aqueous solution containing a preselected nucleophile to react with the reactive polyester and provide the final shell components; heating the resulting suspension to accomplish radical polymerization of the core monomers; washing the resulting toner particles with water; and spray or freeze drying the washed particles to allow the final encapsulated toner product.

In the present invention, shells for the cores are obtained by known interfacial polymerization processes or more specifically by a two stage interfacial polycondensation which is based upon the control of the stoichiometric balance between the oil- and water-soluble shell monomers. Preparation of reactive or telechelic polymers through interfacial polycondensation of nonstoichiometric balanced monomers is well known, see Nguyen, H. A. and Marechal, E. *Review of Macromolecular Chemistry and Physics*, 1988, C28(2), 187 to 291; and Percec, V.; Coleen P.; Pask, S. D. in *Comprehensive Polymer Science*, 1989, vol. 6, chapter 9, Allen, G. Editor, the disclosure of which is totally incorporated herein by reference. Of background interest is the article "Synthesis of Block Copolymers via Two-Step Interfacial Polycondensation", Tsai, H. B. and Lee, Y. -D. *Journal of Polymer Science Polymer Chemistry Edition*, 1987, 25, 3405 to 3412, the disclosure of which is totally incorporated herein by reference. This article discloses that a reactive polyester with carboxylic acid chloride end groups was obtained within ten minutes when the molar ratio of bisphenol A to a diacid chloride was less than one. In the second stage, the reactive polyester was reacted with additional bisphenol to provide a final polyester with increased molecular weights.

Encapsulated toners with polyester shells are well known. There were recited in a patentability search as prior art U.S. Pat. Nos. 4,699,866 directed to encapsulated toner materials with improved powder characteristics, see for example the Abstract of the Disclosure, and wherein the shell material can be selected from a variety of resins including polyesters, reference column 3, beginning at line 19, and wherein encapsulation can be accomplished by interfacial polymerization, reference column 3, beginning at line 29, to column 4, line 18, for example, the disclosure of the aforementioned patent being totally incorporated herein by reference; 4,774,160 directed to toner compositions with amorphous ternary copolycarbonates, reference for example the Abstract of the Disclosure and column 5, although there does not appear to be any teaching in this patent with respect to encapsulated toners; 4,049,477 directed to finely divided toner particles comprising a colorant in an amorphous low melting aromatic polyester wherein the polyester contains within the polymer chain at least 30 mol percent of at least one divalent radical, reference the Abstract of the Disclosure, and wherein the polyesters can be prepared by any conventional condensation or transesterification polymerization process, reference column 5, beginning at line 56, however, it does not seem to be any mention of encapsulated toners in this patent; and 4,758,506 directed to encapsulated cold pressure fixable toners comprised of a core containing magnetite particles and a styrene butadiene styrene block polymer and a polymeric shell material generated by an interfacial polymerization process, see the Abstract of the Disclosure, and note column 5, beginning at line 46, wherein it is indicated that the shell materials can be prepared by interfacial polycondensation processes as disclosed, for example, in U.S. Pat. No. 4,000,087, and wherein polyamides, polyureas, and polymeric shells are mentioned, see column 5, beginning at line 52. Also known are thermotropic liquid crystalline polymers, especially polyesters, as shell materials for heat fusible encapsulated toners, however, the aforementioned polyesters are considered costly and the formation of these shells with reasonable desired molecular weights have in some instances not been readily achievable. With the present invention, in some embodiments, there are selected as the shell low melting amorphous polyesters derived from economical and expensive diacid chlorides, such as phthaloyl, isophthaloyl, or tetraphthaloyl dichlorides and the corresponding halides and bisphenols such as resorcinols, hydraquinones, bisphenol A, bisphenol F, and the like.

With further specific reference to the prior art, there are disclosed in U.S. Pat. No. 4,307,169 encapsulated electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there are disclosed in the prior art encapsulated toner compositions containing costly pigments and dyes, reference for example the color photocapsule toners of U.S. Pat. Nos. 4,399,209; 4,482,624; 4,483,912 and 4,397,483. In U.S. Pat. No. 4,803,144, there is enclosed microcapsule toners obtained by interfacial polymerization microencapsulation process wherein a preformed polymer is employed as the core binder. The process of this invention also involved the use of suitable low boiling solvent to dissolve the polymer binder, and to promote the interfacial polymerization process.

Moreover, illustrated in U.S. Pat. No. 4,758,506, the disclosure of which is totally incorporated herein by reference, are single component cold pressure fixable toner compositions, wherein the shell selected can be prepared by an interfacial polymerization process. A similar teaching is present in application U.S. Ser. No. 718,676 (now abandoned), the disclosure of which is totally incorporated herein by reference. In the aforementioned application, the core can be comprised of magnetite and a polyisobutylene of a specific molecular weight encapsulated in a polymeric shell material generated by an interfacial polymerization process.

There are disclosed in Konishiroku Japanese Publications Nos. 60/198554 A2, 60/198555 A2, and Canon Japanese Publication No. 61/65260 A2 heat fusible encapsulated toner compositions in which the shell of the encapsulated toner is prepared by an overcoating process involving the use of an organic solvent and polymeric materials of high melting points with a sufficient glass transition temperature to provide good blocking properties for these compositions. In contrast to the processes disclosed in the Japanese publications, the shells of the present invention can be prepared by interfacial polymerization in a simplified continuous one step process wherein the core and the shell of the toner are simultaneously formulated, which process therefore is of lower cost, that is from about 15 to about 40 percent less than the aforementioned prior art processes.

There is disclosed in Japanese Publication No. 61/56352 A2 heat fusible encapsulated toner compositions with a core prepared by in situ free radical polymerization with an epoxy-urea shell of a very high melting temperature. These toners do not ordinarily possess low melting properties, that is they usually cannot be heat fixed with fusers set at temperatures as low as 120° C. In contrast, the toner compositions of the present invention can be used both in conventional heat fusing imaging systems wherein high melting materials with, for example, a softening point above 100° C. are required necessitating fuser temperatures of up to 180° C., and in low melt applications as the shell and the core can be formulated accordingly.

Additionally, there are disclosed in Japanese Publication No. 61/118758 A2, Japanese Publication No. 59/218460 A2, Japanese Publication No. 61/28957 A2, Japanese Publication No. 60/175057 A2, and Japanese Publication No. 60/166958 A2 heat fusible toner compositions prepared by suspension polymerization. Examples of patents illustrating colored photocapsule toners include U.S. Pat. Nos. 4,399,209; 4,482,624; 4,483,912 and 4,397,483. More specifically, the '483 patent illustrates encapsulated toner materials which have applications in very specific areas such as pressure sensitive recording paper. Capsules prepared for this application are usually coated on a substrate directly from the emulsion in which they are prepared and withstand with difficulties spray drying processes, a disadvantage alleviated with the toners prepared in accordance with the process of the present invention. Furthermore, these capsules contain an organic liquid in the core which, when used in a dry development system, could result in poor fix properties. Also, the range of particle sizes prepared by the aforementioned prior art process results in the formation of pressure sensitive recording particles which are usually not acceptable for electrostatographic development systems.

Moreover, there is described in U.S. Pat. No. 4,476,211, the disclosure of which is totally incorporated herein by reference, the preparation of electrostatographic toner materials with surface electroconductivity. Specifically, there is disclosed in the '211 patent a cold pressure fixable toner composition with polyamide, polyurea and other types of shell materials prepared by an interfacial polymerization process. The colorant selected for these compositions is generally comprised of a variety of dyes or pigments, and the core contains a polymeric material with a binder therein for retaining the colorant within the core and assisting in the fixing of the colorant onto the surface of a support medium. Examples of high boiling liquids selected for the process of the '211 patent include those boiling at temperatures higher than 180° C. such as phthalic esters, phosphoric acid esters, and alkyl naphthalenes.

Also, there are illustrated in U.S. Pat. No. 4,543,313, the disclosure of which is totally incorporated herein by reference, toner compositions comprised of resin particles selected from the group consisting of thermotropic liquid crystalline polycarbonates, copolycarbonates, polyurethanes, polyesters, and copolyesters; and pigment particles. The aforementioned thermotropic liquid crystalline polymers, especially the polyesters and the polyurethanes, are useful as shells for the toner compositions of the present invention. However, the toner compositions of the '313 patent are not encapsulated and are prepared by conventional processes, such as melt blending and jetting.

Disclosed in application U.S. Ser. No. 043,265, the disclosure of which is totally incorporated herein by reference, toner compositions comprised of core components, and thereover a thermotropic liquid crystalline polymeric shell formulated by interfacial polymerization. Further, in this application there is described black or colored toner compositions comprised of a polymer core or polymer mixtures, and pigment particles encapsulated in a shell formulated by interfacial polymerization processes, which shell is selected from the group consisting of thermotropic liquid crystalline polyesters, polycarbonates, polyurethanes, copolycarbonates, and copolyesters, reference the aforementioned U.S. Pat. No. 4,543,313. Therefore, in one specific embodiment of the aforementioned application the toner compositions are comprised of a polymer core having dispersed therein as pigments components selected from the group consisting of black, cyan, magenta, yellow, red, magnetites, and mixtures thereof; and thereover a thermotropic liquid crystalline polymeric shell. Also, additive particles in an amount of from about 0.1 percent by weight to about 1 percent by weight, such as colloidal silicas, inclusive of Aerosils and/or metal salts, or metal salts of fatty acids, inclusive of zinc stearate can be added to the formulated encapsulated toner. Moreover, there can be incorporated into the toner compositions of the copending application charge enhancing additives in an amount of from about 1 percent to about 20 percent by weight to enable positively charged toner compositions, which additives include alkyl pyridinium halides, reference U.S. Pat. No. 4,298,672, the disclosure of which is totally incorporated herein by reference; sulfate and sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and the like. Furthermore, there are provided in accordance with the copending application processes for the preparation of toner compositions wherein the shell component is obtained by interfacial polymerization.

In one preferred specific embodiment of the aforesaid copending application, there are illustrated toner compositions comprised of a core of (1) a pre-polymerized styrene-n-butylmethacrylate copolymer with a glass transition temperature of about 55° C. present in an amount of from about 1 percent by weight to about 30 percent by weight and preferably from about 10 percent by weight to about 20 percent by weight, and an in situ polymerized styrene polymer present in an amount of from about 30 to about 50 percent by weight of the toner; and (2) a mixture of magnetite, from about 1 percent to about 60 percent by weight, and preferably from about 1 percent to about 30 percent by weight, and carbon black from about 2 percent to about 15 percent by weight, and preferably from about 3 to about 10 percent by weight, encapsulated with a polyester thermotropic liquid crystalline shell present in an amount of from about 10 percent to about 25 percent by weight. The resulting toner has a core/shell morphology with a shell thickness of from about 0.05 to about 1.0 micron. With further respect to the specific aforementioned compositions, there can be present in the core either carbon black or magnetite in an amount of from about 3 to about 8 percent, and from about 15 to about 20 percent, respectively.

Illustrated in U.S. Pat. No. 4,758,506, the disclosure of which is totally incorporated herein by reference, are single component cold pressure fixable toner compositions, wherein the shell selected can be prepared by an interfacial polymerization process. A similar teaching is present in copending application U.S. Ser. No. 718,676 relating to cold pressure fixable toners, the disclosure of which is totally incorporated herein by reference. In the aforementioned application, the core can be comprised of magnetite and a polyisobutylene of a specific molecular weight encapsulated in a polymeric shell material generated by an interfacial polymerization process.

SUMMARY OF THE INVENTION

It is an object of the present invention to provide encapsulated toner compositions with many of the advantages illustrated herein.

It is also an object of the present invention to provide encapsulated toner fabrication processes with many of the advantages illustrated herein.

In another object of the present invention there are provided encapsulated toner compositions comprised of a core of resin binder, pigments and/or dyes surrounded by a modified polyester shell prepared, for example, by a two stage interfacial polymerization process.

A further object of the present invention is to provide heat fixable microcapsule toner compositions which offer low melt characteristics.

An additional object of the present invention resides in the provision of encapsulated toners that permit fuser life extension and improve wear resistance thereof in view of, for example, the lower fixing temperatures that can be selected for the toners obtained, and the selection of lower fusing energies, that is from about 25 to 50 percent, and preferably between 25 and 35 percent lower as compared to several known encapsulated toner compositions.

Also, another objective of the present is to provide encapsulated color and black toner compositions which offer excellent image quality such as high fix, high resolution, high gloss, high color chroma, high transparency projection efficiency and other desirable color toner characteristics.

Another object of the present invention is to provide economical and simple processes for the preparation of high quality pigment dispersions for in situ toner particle formation, reduced toner pile height, small size diameter toners with narrow size distribution, and toners with improved color properties and excellent overall print characteristics.

In another object of the present invention there are provided processes for the preparation of toner compositions containing core components such as pigment, copolymer dispersants and toner resins and the condensation polymer shells as illustrated in U.S. Pat. No. 4,543,313, the disclosure of which is totally incorporated herein by reference, which toners are useful in electrophotographic imaging and printing processes.

In another object of the present invention there are provided developer compositions formulated by admixing carrier particles with the toner compositions obtained by the processes illustrated herein.

Further, another object of the present invention is the provision of microcapsule toners with excellent surface release and powder flow properties without surface additives such as Aerosols.

An additional object of the present invention resides in encapsulated black or colored toner compositions formulated by the interfacial polymerization processes, and wherein agglomeration of pigment particles is eliminated or minimized.

In another object of the present invention there are provided simple, and economical processes for black and colored toner compositions formulated by an interfacial/free-radical polymerization process in which the shell formation (interfacial polymerization), core formation (free-radical polymerization), and the resulting material properties are independently controlled.

Another object of the present invention resides in the provision of simple one-pot economical process for manufacturing black, and colored toners of specific particle size and size distribution while avoiding the prior art costly subsequent particle size classification processes.

Moreover, in another object of the present invention there are provided certain modified shell polyesters which include block and branched polyesters and linear polyesters with specific chain ends. Also, the morphological properties of the polyesters selected can be semicrystalline, amorphous or (thermotropic) liquid crystalline depending on the type of the shell monomers used.

Also, in another object of the present invention there are provided a two stage interfacial shell formation process for the preparation of the modified polyester shells. The process involves the formation of a reactive polyester with acid chloride ends through interfacial polymerization of an acid chloride, the oil-soluble shell monomer with a bisphenol, and a water soluble shell monomer, under stoichiometric imbalanced condition. Thus, there is a slight excess of the total acid chloride functionality as compared with the phenolate functionality. The reactive prepolyester is then reacted in the second stage with a mono-, di-or poly-functional neucleophile to provide a linear, block, or branched shell polyester selected as encapsulating components for the toners of the present invention. The chemistry of the two stage shell formation process in one embodiment of the present invention is depicted in the following reaction scheme. In the first stage, one equivalent of a diacid chloride is reacted with less than one equivalent of a bisphenol in the presence of a phase transfer catalyst to provide a linear reactive polyester with acid chloride ends. The resulting product is then reacted with a monofunctional, difunctional or polyfunctional nucleophile ($XYR^1$, $XYR^2YX$ or $(XY)uR^3$, respectively) to provide a linear polyester with groups, wherein XYRu and the like are as defined herein, an elongated linear polyester or a branched polyester, reference the following reaction scheme.

REACTION SCHEME

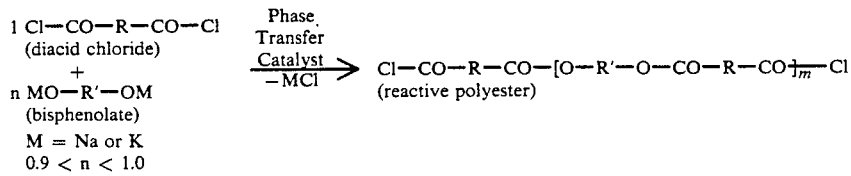

-continued

REACTION SCHEME

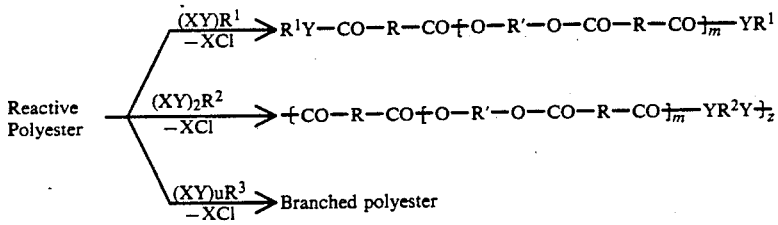

R = —Ph—; —$(CH_2)_8$—; —$(CH_2)_{12}$— etc.
R' = —Ph—$CH_2$—Ph—; —Ph—$C(CH_3)_2$—Ph; —Ph—S—Ph—; —Ph—O—Ph— etc.
$(XY)R^1$ = butylamine; aniline; sodium or potassium t-butyl phenolate; sodium or potassium thiophenolate.
$(XY)R^2$ = 1,6-hexane diamine; sodium or potassium salt of bisphenol A, bisphenol S, bisphenol F and the like.
$(XY)uR^3$ = 1,3,5-triaminobenzene; tris(2-aminoethyl)amine; tetra sodium or potassium salt of tetra(4-hydroxyphenyl)ethane and the like.

The reactive polyester with a branched structure can be obtained by selecting for the process a small, 5 weight percent, amount of a triacid chloride, such as benzene tricarboxylic acid. The branched reactive polyester will lead to the formation of branched final polyester after the second addition. This process allows the preparation of polyester shells which permit, for example, control of the surface properties of the toner particles. For example, a nucleophile containing nitrile, halogenated or perfluorinated groups can offer negatively charging particles, while a quarternary amino or amide bearing nucleophile will yield positive toners.

These and other objects of the present invention are accomplished by the provision of toners and processes for the preparation of toner compositions. More specifically, the present invention is directed to processes for the preparation of encapsulated toner compositions which comprises dispersing pigment particles into a vinyl monomer core solution; thereafter dispersing the pigmented core components into an aqueous solution containing an emulsifier, and subsequently encapsulating the core components by a two stage interfacial polymerization. In one specific embodiment, the process of the present invention comprises mixing 20 to 50 parts of a pigment and 75 to 25 parts of vinyl monomers; admixing 50 to 70 parts of the aforementioned mixture with 5 to 25 parts of shell monomers, 10 to 30 parts of preformed toner core resins and 2 to 5 parts of radical initiators with a wrist action shaker or a roll mill for 30 minutes to form a homogeneous pigment dispersion; dispersing 10 to 20 parts of the dispersion into 50 to 200 parts of an aqueous emulsifier solution at 5° to 25° C. with a Brinkman homogenizer at 5,000 to 10,000 rpm for 15 seconds to 5 minutes to provide a suspension of pigmented droplets; subsequently encapsulating the core comprised of the pigment, the preformed resins and the vinyl monomers by accomplishing the first stage interfacial polymerization of the shell monomers with effective amounts of second shell monomers to obtain a stable suspension of encapsulated droplets with reactive polyester shells; adding a neucleophile to react with the reactive shell polyester to complete the shell formation; heating the suspension at 70° to 75° C. for 15 to 24 hours and then at 85° to 90° C. for 5 to 10 hours to accomplish free radical suspension polymerization of the vinyl monomers and to provide encapsulated toner particles; washing the particles repeatedly with deionized water (10 to 20 times with 3 to 4 liters of water); and then spray drying the washed particles with a Yamato DL-41 spray dryer at an inlet temperature of 125° to 130° C. to provide 50 to 80 percent yields of a final encapsulated toner product in this embodiment of the present invention.

Further embodiments of the present invention include a process for the preparation of encapsulated toner compositions which comprises a core component and a shell component derived from a reactive polyester by (1) providing a pigment dispersion comprised of monomers capable of being polymerized by free radical polymerization, a colorant or pigment and a free radical initiator, a polymer and an oil soluble shell monomer or monomers; (2) dispersing the aforementioned dispersion in an aqueous phase containing an emulsifier, an optional surfactant, an optional antifoaming agent, and an optional phase transfer catalyst; (3) adding less than a stoichiometric amount of a water soluble shell monomer to initiate the first stage of interfacial polymerization to form the reactive polyester shells; (4) adding a neucleophile to further react with the reactive polyester and complete the shell formation process; (5) heating the aqueous suspension of the encapsulated particles thereby effecting in situ polymerization of the core monomers; (6) washing the toner product with deionized water; and (7) drying the washed toner product.

The polyester shells selected for the toners of the present invention are derived from economical diacid halides, including chlorides, the derivatives thereof, such as phthaloyl, isophthaloyl, or terephthaloyl dichloride; sebacoyl chloride, dodecanedioyl dichloride, trans-5-norbornene-2,3-dicarbonyl chloride, fumaryl chloride, suberoyl chloride, 3,3-diethyl glutaryl dichloride, 4,4'-biphenyldicaronyl dichloride, benzene tricarbonyl trichloride and the like. Also, there may be selected dihydroxy phenyl compounds including dihydroxy benzenes, such as resorcinol derivatives and hydroquinone derivatives, and bisphenols of the following examples as well as their derivatives, such as bisphenol A, 4,4'-biphenol,4,4-dihydroxydiphenyl ether, 3,3'- and 4,4'-(ethylenedioxy)diphenol, 3,3'- and 4,4'-(butylenedioxy)diphenol, 4,4'-(hexafluoroisopropyldene)diphenol, 3,3'- and 4,4'-dihydroxydiphenyl ether, 3,3'- and 4,4'-biphenol, 4,4'-thiobisphenols, 4,4'-[1,3-phenylenebis(1-methyl-ethylidene)]bisphenol, 4,4'-bis(4-hydroxyphenyl)valeric acid and its alkylates, phenolphthalein and 3,3'- and 4,4'-methylenediphenols.

In a specific embodiment of the present invention, there is provided a process for the preparation of encapsulated toners which comprises preparing a pigment mixture containing core monomers, a colorant, free radical initiators and diacid halide shell monomers; dispersing the mixture in an aqueous solution containing emulsifiers and a phase transfer catalyst; adding to the resulting suspension a bisphenol solution, which was prepared by dissolving the bisphenol in the aqueous sodium or potassium hydroxide solution, whereby the bisphenol and diacid halide react to form an acid halide terminated reactive polyester; and subsequently adding to the solution nucleophilic monomers, such as amines, phenolates, thiophenolates and the like capable of reacting with the diacid halide terminated polyesters, thereby resulting in formation by interfacial polymerization of a modified polyester shell component surrounding the core components. The weight average molecular weight of from about 5,000 to about 200,000 of the reactive polyester shell can be controlled by adjusting the molar ratio of bisphenol to diacid halide of, for example, from 0.90 to 0.99. Further, the final modified polyester shells can have equivalent or increased molecular weights depending on selection of a monofunctional, difunctional, or trifunctional nucleophile or base for the second stage of shell formation. Typical neocleophiles or bases include amino, phenolic and thiophenolic compounds. Specific monofunctional bases include 4-butylaniline, phenylaniline, chloroaniline, trifluoromethylaniline, butoxyaniline, aminobenzonitrile, 3,5-bis(trifluoromethyl)-aniline, aminobiphenyl, sodium or potassium 2-aminoethane sulfonate, sodium or potassium 5- or 8-amino-2-naphthalenesulfonate, sodium or potassium 4-amino-benzoate, 4-butyl, 4-octyl, 4-phenyl, bromo, chloro, and trifluoromethyl phenol, bromothiophenol, butyl thiophenol, benzoxazol-2-thiol and the like. Difunctional bases can be selected from the following diamines such as 1,6-hexanediamine, 2,4-diamino cumene, methylene bis(di-o-toluidine), diamino benzenes, 4,4'-thiodianiline, 4,4'-oxidianiline, 1,3-bis-(aminomethyl)cyclohexane, 4,4'-diamino dicyclohexyl methane, 3,3'- and 4,4'-dapson, xylene diamines, dithiophenols, 4,4'-dithiobiphenyls, and the like and the aforementioned dihydroxy benzenes and bisphenols. Also, there may be selected polyfunctional amines and phenols can be selected from tris-(2-aminoethyl)amine, tris(2-aminoethyl)amine, 3,3'-diaminobenzidine, 1,3,5-triaminobenzene, 1,1,1-tris(4-hydroxyphenyl)ethane, tetra(4-hydroxyphenyl)ethane, 3,3',4,4'-tetrahydroxy biphenyl and the like. For example, negatively charging toner particles can be prepared from shell monomers and/or bases with halogen, sulfone, nitrile, nitro or electron withdrawing groups; positive particles can be obtained using shell monomers and/or bases containing amino, maleimide, amide groups, nitrogen atoms, and the like.

One preferred method for the preparation of the encapsulated toner compositions of the present invention comprises (1) adding 5 to 30 parts of a prepolymer, typically the copolymer of styrene and butyl methacrylate, or styrene and butadiene and 10 to 30 parts of a predispersed magenta pigment powder which is a 50/50 mixture of the magenta pigment and a toner resin, typically the copolymer of styrene and butylmethacrylate, into 30 to 50 parts of a solution of vinyl core monomers; (2) mixing the aforementioned mixture with a mechanical shaker or a roll mill overnight (about 18 hours); (3) adding 5 to 15 parts of an oil soluble first shell monomer or monomers and 1 to 5 parts of free radical initiator or initiators to the mixture; (4) mixing the shell monomer(s) and the initiator(s) with a shaker for about 30 minutes to provide a pigment dispersion comprised of all the aforementioned components; (5) dispersing 10 to 20 parts of the dispersion into 50 to 200 parts of an aqueous emulsifier solution, which is comprised of 0.1 to 4 weight percent of an emulsifier, or a combination of more than one emulsifier and an optional phase transfer catalyst in an amount of from about 0.001 to 1 weight percent of the oil shell monomers with a Brinkmann PT45/80 homogenizer equipped with a 35/4G probe at 5,000 to 10,000 rpm for 15 seconds to 5 minutes at 5° to 25° C. to provide an oil-in-water (o/w) suspension; (6) adding to the suspension an aqueous solution of a second shell monomer or monomers at the molar ratio of 0.9 to 1.1 with respect to the first shell monomer(s) to initiate the first stage of interfacial polymerization and to form reactive polyester shells; (7) allowing the suspension to stir for 10 to 20 minutes; (8) adding to the resulting suspension 0.1 to 0.5 parts of a neucleophile such as amino compounds, phenolate, sodium or potassium phenolate or thiophenolate, which could be present in powder form or solubilized in an aqueous solution; (9) stirring was continue for 1 to 2 hours; (10) adding to the resulting suspension from about 0.1 to 100 parts of a 2 percent aqueous protective colloid solution; (11) heating the entire suspension at 75° C. for 15 to 24 hours and then at 85° to 90° C. for 5 to 10 hours to accomplish free radical suspension polymerization of the core monomers and to yield encapsulated particles; (12) washing the particles 10 to 20 times with 600 to 800 parts of deionized water; (13) sieving the washed particles through a combination of 425 and 250 micron sieves; and (14) drying the particles with a Yamato DL-41 spray dryer at an inlet temperature of about 100° to 130° C. thereby yielding free flowing magenta toner particles.

Examples of core monomers present include but are not limited to addi'ion-type monomers such as methacrylates including butyl acrylate, lauryl methacrylate, hexyl methacrylate, propyl acrylate, benzyl acrylate, pentyl acrylate, hexyl acrylate, cyclohexyl acrylate, dodecyl acrylate, ethoxy propyl acrylate, heptyl acrylate, isobutyl acrylate, methyl butyl acrylate, m-tolyl acrylate, ethyl methacrylate, n-butyl methacrylate, i-butyl methacrylate, hydroxypropyl methacrylate, allyl methacrylate, dimethylaminoethyl methacrylate, dimethylaminopropyl methacrylate, n-hexyl methacrylate, cyclohexyl methacrylate, 2-ethylhexyl methycrylate, decyl methacrylate, lauryl methacrylate, stearyl methacrylate, 2-phenylethyl methacrylate, furfuryl methacrylate, tetrahydrofurfuryl-2-methacrylate, styrene, dodecyl styrene, hexyl methyl styrene, nonyl styrene, octyl styrene, tetradecyl styrene, acrylates, or other substantially equivalent addition monomers. Various specific suitable monomers or mixtures, which mixtures contain, for example, from about 10 percent to about 90 percent by weight of a first monomer and from about 90 percent to about 10 percent by weight of a second monomer in an amount of from about 10 percent to about 85 percent by weight, and preferably from about 30 percent to about 75 percent by weight can be selected for incorporation into the core of the toner compositions of the present invention. Also, three or more monomers may be selected for use in some embodiments of the present invention. Typical specific examples of monomers include styrenes, methacrylates, acrylates, polyolefins, mixtures thereof, and the like. Examples of specific core polymer components resulting from the polymerization of monomers include copolymers of styrene and methylmethacrylates; styrene and methylacrylates; styrene and butadiene with a styrene content of greater than about 75 percent by weight; styrene n-butylmethylacrylate copolymers; styrene n-lauryl methacrylate and the like, including terpolymers of the above. In a preferred embodiment of the present invention, the polymer and/or copolymer core is prepared in situ by free radical polymerization processes in the presence of the selected combination of a pigment and a block polymer. Other polymers or mixtures thereof can be selected for the core providing the objectives of the present invention are achieved.

Illustrative examples of free-radical initiators selected for the preparation of the toners of the present invention include azo compounds such as 2-2' azodimethylvaleronitrile, 2-2' azoisobutyronitrile, azobiscyclohexanenitrile, 2-methylbutyronitrile 2,2' azo-bis-2,4-dimethylvaleronitrile, and Vazo® commercially available from E. I. DuPont Corporation, or mixtures thereof in an amount that will permit a core polymer with specific molecular and physical characteristics. Examples of other initiators include those available from Pennwalt Corporation such as Lupersol®, Lucidol®, Luperco®, Alperox® and Decanox®.

Control of polymerization rates and molecular weight can be achievable through the use of difunctional or polyfunctional initiators in conjunction with an appropriate time-temperature profile for the polymerization reactions. Furthermore, diacyl peroxides can also be selected as initiators providing they are active at temperatures below about 100° C. for the processes of in situ polymerization described therein, the quantity of initiator(s) being, for example, from about 0.5 percent to about 10 percent by weight of that of core monomer(s).

Suitable colorants for use in the encapsulated toner compositions of the present invention include various known pigments or dyes present in the core in an effective amount of, for example, from about 2 to about 15 percent by weight. Illustrative examples of selected colorants are carbon black, magnetites, such as Bayer magnetite, Bayferrox 8600, 8610, Northern Pigments NP-608, NP-604, Magnox TMB-100, TBM-104, Mobay magnetite, MO8029, MO8060, Columbian Pigments magnetites, Pfizer magnetites and other equivalent black pigments. Generally, colored pigments that can be selected include red, blue, brown, green, cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Other illustrative colored pigments include Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E.D. Toluidine Red and Bon Red C available from Dominion Color Corporation Ltd., Toronto, Ont., NOVAperm Yellow FGL, Hostaperm Pink E from Hoechst, Cinquasia Magenta available from E. I. DuPont de Nemours & Company, Oil Red 2144 from Passaic Color and Chemical. The aforementioned pigments are incorporated into the microcapsule toner compositions in various suitable effective amounts. In one embodiment, these colored pigment particles are present in the toner composition in an amount of from about 2 percent by weight to about 75 percent by weight calculated on the weight of the dry toner. Colored magnetites, such as mixtures of Mapico Black, and cyan components may also be used as pigments for the toner compositions of the present invention. In addition, there can be selected in place of the disclosed pigments dyes such as Oil Blue A, Passaic Oil Green, Sudan Red, Sudan Yellow 146, DuPont Oil Blue A, Passaic Oil Red 2144, Oil Yellow, Sudan Red 7B, Oil Pink 312, Pylachrome Pink LX1900, Sudan Black B, Ceres Blue R, Sudan Deep Black, and Ceres Black BN. The dye is usually present in the core in the amount of from about 1 percent to about 40 percent by weight, and preferably in an amount of from about 15 percent by weight to about 25 percent by weight.

Examples of shell polymers include the amorphous polyesters illustrated herein, especially those with functional groups thereon. The shell content is generally from 5 to 30 percent by weight of the toner composition, and the shell usually has a thickness generally, for example, of less than about 5 microns, and more specifically from about 0.1 to about 3 microns. Other shell contents, and thicknesses may be selected providing, for example, that some of the objectives of the present invention are achievable.

Interfacial polymerization processes selected for shell formation for the toners of the present invention are as illustrated, for example, in U.S. Pat. Nos. 4,000,087 and 4,307,169, the disclosures of which are totally incorporated herein by reference.

Surface additives from 1 to 20 weight percent of the toner, for example, can be selected for the toners of the present invention including, for example, metal salts, metal salts of fatty acids, colloidal silicas, mixtures thereof and the like, which additives are usually present in an amount of from about 0.1 to about 3 weight percent, reference U.S. Pat. Nos. 3,590,000; 3,720,617; 3,655,374 and 3,983,045, the disclosures of which are totally incorporated herein by reference. Preferred additives include zinc stearate and Aerosil.

Also, the toner compositions of the present invention can be rendered relatively conductive with, for example, a volume resistivity of from about $5\times10^4$ ohm-cm to about $5\times10^6$ ohm-cm by adding to the surface thereof components of about 2 to 10 weight percent of the toner, such as carbon blacks, graphite, copper iodide and other conductive materials. The advantage of conductive toner surface enables the use of inductive development systems such as those employed in the commercial Delphax printer machines.

The core may further contain additives in an amount of from 1 percent to about 40 percent by weight, and preferably in an amount of from about 1 to about 15 percent by weight such as metallic soaps, waxes, silicone derivatives and/or other releasing agents, that is for example additives which reduce adhesion of the final toner to the fuser roll in, for example, xerographic imaging and printing apparatuses including metal salts of fatty acids such as zinc stearate. Moreover, subsequent to encapsulation the toner compositions of the present invention can have added thereto as surface components to, for example, improve the toner flow properties and to control the electrical properties thereof. These components, which are present in amounts of, for example, from about 0.1 percent to about 5 percent by weight, include colloidal silicas, such as Aerosil R972 and metal salts, and/or metal salts of fatty acids, reference U.S. Pat. Nos. 3,590,000; 3,655,374; 3,900,588 and 3,983,045, the disclosures of which are totally incorporated herein by reference.

Also, for the primary purpose of controlling the particle size of the particles or toners prepared by the process of the present invention, it is preferred to select a surfactant or a mixture of surfactants during preparation thereof. The surfactants also assist in stabilizing the particles during the in situ polymerization phase and prevents or minimizes aggregations of the particles. Examples of surfactants present in an effective amount of, for example, from about 0.05 percent to about 3 percent by weight of the aqueous phase, and preferably from about 0.05 percent to about 1 percent by weight include both ionic and nonionic surfactants, such as polyvinylalcohol, polyethylene sulfonic acid salt, carboxylated polyvinylalcohol, water soluble block copolymers such as the Pluronics® and Tetronics® commercially available from BASF, cellulose derivatives such as hydroxypropyl cellulose, hydroxyethyl cellulose, methyl cellulose and the like; and inorganic sufactants such as trisodium polyphosphate, tricalcium polyphosphate, and the like. Lignosulfonate and polyelectrolyte dispersants can also be used, including those available from W. R. Grace Chemical Company as Daxad TM.

For the process of the present invention, the aqueous phase may contain, in addition to the surfactant or mixture of surfactants disclosed herein, an antifoaming agent such as aliphatic alcohols, preferably containing from about 8 to about 20 carbon atoms, providing the alcohol is at least partially soluble in water, such as 2-decanol, which alcohol is present, for example, in an amount of from 0.01 percent to about 0.5 percent by weight and preferably from 0.01 percent to 0.1 percent by weight. The primary function of the alcohol is to control foaming during the dispersion of the monomer mixture into the water mixture. As a phase transfer agent or components selected for the primary purposes of modification of the kinetics of the interfacial polymerization, the kinetics of shell formation, controlling the yield of polymer shell formation, and molecular dispersion, and present in an effective amount of from, for example, about 0.001 to about 1 percent by weight of the aqueous phase, and preferably between 0.01 and 0.5 percent by weight, there is mentioned (1) ammonium salts such as benzyl triethyl ammonium chloride, benzyl triethyl ammonium bromide or other alkylated ammonium salts such as tetraethyl ammonium salts, and the like; (2) crown ethers or cryptate type phase transfer agents such as benzo-18-crown-6, and the like. Other phase transfer agents that may be selected are illustrated in a compendium on phase transfer reactions, Georg Thieme Verlag Stuttgart, New York, 1986, the disclosure of which is totally incorporated herein by reference. The aqueous phase may also contain a free radical polymerization inhibitor in, for example, an effective amount such as from about 0.01 percent to about 1.0 percent by weight, and preferably from 0.01 percent to 0.1 percent by weight, such as alkali metal halides including potassium iodide, potassium chloride, and the like; and a base component such as potassium hydroxide or sodium hydroxide, and the like providing that the objectives of the present invention are achievable.

Examples of carrier particles and photoconductive imaging members that can be selected for use with the toner compositions of the present invention are described in U.S. Pat. No. 4,543,313, the disclosure of which is totally incorporated herein by reference. More specifically, illustrative examples of carrier materials that can be selected for mixing with the toner particles obtained by the process of the present invention include those substances that are capable of triboelectrically obtaining a charge of opposite polarity to that of the toner particles. Accordingly, the carrier particles of the present invention are selected so as to be of a negative or positive polarity enabling the toner particles that are positively or negatively charged to adhere to and surround the carrier particles. Specific examples of carriers are granular zircon, granular silicon, methyl methacrylate, glass, steel, nickel, iron ferrites, and the like. The carriers are in some embodiments of the present invention preferably spherical in shape. Generally, from about 2 to about 5 parts per 100 parts by weight of carrier particles are admixed for the formation of the aforesaid developer compositions.

The selected carrier particles can be coated, the coating generally being comprised of fluoropolymers, such as polyvinylidene fluorides, terpolymers of styrene, methyl methacrylate, and a silane, inclusive of triethoxy silane, tetrafluoroethylenes, and the like at, for example, coating weights of from about 0.1 to about 3 weight percent, and coatings are not in close proximity in the triboelectric series, such as those illustrated in U.S. Pat. Nos. 4,937,166 and 4,935,326, the disclosures of which are totally incorporated herein by reference.

The diameter of the carrier particles can vary. Generally, however, they are from about 50 microns to about 1,000 microns allowing these particles to possess sufficient density and inertia to void adherence to the electrostatic images during the development process. The carrier particles can be mixed with the toner particles in various suitable combinations, however, in a preferred embodiment about 1 part per toner to about 10 parts to about 200 parts by weight of carrier are mixed.

Examples of known photoconductive imaging members that can be selected include amorphous selenium, selenium alloys, layered members as illustrated in U.S. Pat. No. 4,265,990, the disclosure of which is totally incorporated herein by reference; and the like.

The following examples are being submitted to further define various species of the present invention. These examples are intended to be illustrative only and are not intended to limit the scope of the present invention. Also, parts and percentages are by weight unless otherwise indicated.

EXAMPLE I

Into a 500 milliliter polypropylene (PP) bottle was added styrene (80 grams) and butyl methacrylate (BMA, 140 grams) and predispersed Hostaperm Pink E pigment (80 grams), which is a 50/50 mixture of the aforementioned Hostaperm Pink E pigment in a styrene-butyl methacrylate polymer, and a 60/40 solution of styrene-butyl methacrylate polymer in styrene (140 grams). The resulting mixture was shaken overnight with a Burrel wrist action shaker. AIBN initiator (4 grams), VAZO 52 (4 grams), isophthaloyl chloride (26 grams) were then added to the mixture, which was subsequently shaken with the shaker for 30 minutes to provide a pigment dispersion comprised of the aforementioned components. During that time, a bisphenol A solution and a 4-t-butylphenol solution were prepared as follow. In a 150 milliliter PP bottle was added potassium hydroxide (85+percent, 18 grams), water (100 grams), bisphenol A (30 grams) and $K_2CO_3$ (20 grams). The resulting mixture was shaken for about 30 minutes to form a bisphenolate solution. Into another 150 milliliter PP bottle was added potassium hydroxide (2.5 grams), water (22.5 grams) and 4-t-butylphenol (5 grams). The mixture was shaken for 10 minutes to provide a monophenolate solution, and a portion of the pigment dispersion (200 grams) was then added quickly to a homogenizing emulsifier solution (1,000 milliliters, containing 0.6 gram of benzyltriethylammonium chloride, 3 weight percent of Pluronic F108 and 0.3 weight percent of polyvinyl alcohol which was 88 percent hydrolyzed and had number average molecular weight of 96,000) using a Brinkmann homogenizer equipped with a 35/4G probe operating at 9,000 rpm. Homogenization was continued for 35 seconds to provide an oil-in-water (o/w) suspension, which was quickly removed from the homogenizer probe and then stirred with a plastic rod before addition of a portion of the bisphenolate solution (64 grams) all at once. The resulting suspension was then transferred into a 2 liter reaction kettle equipped with mechanical stirrer and condenser. After 10 minutes of stirring, portion of the monophenolate solution (30 grams) was added and stirring was continued for 50 minutes. Two percent Pluronic F38 (400 grams) was then added and the entire mixture was heated at 75° C. for 15 hours and then at 85° C. for 5 hours, and then transferred into a 4 liter beaker. The resulting toner particles comprised of a core containing the passivated pink pigment, styrene-butyl methacrylate polymer and a shell of a polyester with t-butyl phenyl chain ends were washed with water (3 liters×10), sieved through a combination of 425 and 250 micron sieves, and spray dried to provide the above toner (110 grams, 55 percent) with an average particle size of 13 microns, and GSD of 1.8 as determined by a Coulter Counter.

EXAMPLE II

A portion, 200 grams, of the pigment dispersion of Example I was added quickly to a homogenizing (9,000 rpm with 35/4G probe) emulsifier solution (1,000 grams, same solution as that of Example I). Homogenization was continued for 35 seconds to provide an o/w suspension which was quickly removed from the homogenizer probe and then stirred with a plastic rod before addition of a portion of the bisphenolate solution (64 grams) all at once. The resulting suspension was then transferred into a 2 liter reaction kettle equipped with mechanical stirrer and condenser. After 10 minutes of stirring, portion of the bisphenolate solution (15 grams) was added and stirring was continued for 50 minutes. Two percent Pluronic F38 (400 grams) was added and the entire mixture was heated at 75° C. for 15 hours and then at 85° C. for 5 hours, and then transferred into a 4 liter beaker. The resulting toner particles were comprised of a core containing the passivated pink pigment, styrene-butyl methacrylate polymer and a shell of a linear polyester with increased molecular weight and phenoxy chain ends. The toner particles were washed with water (3 liters×10), sieved through a combination of 425 and 250 micron sieves, and spray dried to provide the above toner (105 grams, 50 percent) with an average particle diameter size of 11 microns, and GSD of 1.8 as determined by a Coulter Counter.

EXAMPLE III

Into a 500 milliliter polypropylene (PP) bottle was added styrene (80 grams) and butyl methacrylate (BMA, 140 grams) and predispersed Hostaperm Pink E pigment (80 grams), which is a 50/50 mixture of the aforementioned Hostaperm Pink E pigment in a styrene-butyl methacrylate polymer, and a 60/40 solution of styrene-butyl methacrylate polymer in styrene (140 grams) were then added to the aforementioned mixture. Thereafter, the resulting mixture was shaken overnight (18 hours) with a Burrel wrist action shaker. AIBN initiator (4 grams), VAZO 52 (4 grams), isophthaloyl chloride (18 grams), terephthaloyl chloride (8 grams) were then added to the mixture, which was subsequently shaken with the shaker for 30 minutes to provide a pigment dispersion (474 grams total) comprised of the aforementioned components. A portion of the pigment dispersion (200 grams) was then added quickly to a homogenizing emulsifier solution (1,000 milliliters, same as that of Example I) using a Brinkmann homogenizer equipped with a 35/4G probe operating at 9,000 rpm. Homogenization was continued for 35 seconds to provide an oil-in-water (o/w) suspension, which was quickly removed from the homogenizer probe and then stirred with a plastic rod before addition of a portion of the bisphenolate solution (64 grams, same as that of Example I) all at once. The resulting suspension was then transferred into a 2 liter reaction kettle equipped with mechanical stirrer and condenser. After 10 minutes of stirring, a monophenolate solution (30 grams, same as that of Example I) was added. Stirring was continued for 50 minutes, 2 percent Pluronic F38 (400 grams) added and the entire mixture was heated at 75° C. for 15 hours and then at 85° C. for 5 hours, and then transferred into a 4 liter beaker. The resulting toner particles comprised of a core containing the passivated pink pigment, styrene-butyl methacrylate polymer and a shell of a copolyester with t-butyl phenyl chain ends. The particles were washed with water (3 liters×10), sieved through a combination of 425 and 250 micron sieves, and spray dried to provide the above toner (110 grams, 55 percent) with an average particle diameter size of 15 microns, and GSD of 1.8 as determined by a Coulter Counter.

EXAMPLE IV

Into a 150 milliliter PP bottle was added KOH (7.5 grams, 85+percent), ice water (40 grams), 4-hexyl resorcinol (10.6 grams) and potassium carbonate (8 grams), followed by shaking for 10 minutes to give a resorcinol solution. Portion, 200 grams, of the pigment dispersion of Example III was added quickly to a homogenizing (9,000 rpm with 35/4G probe) emulsifier solution (1,600 milliliters, containing 0.6 gram of benzyl triethyl ammonium chloride and 2 percent Pluronic F108/0.2 percent of polyvinyl alcohol, MW=96,000, 88 percent hydrolyzed). Homogenization was continued for 35 seconds to provide an oil-in-water (o/w) suspension, which was quickly removed from the homogenizer probe and then stirred with a plastic rod before addition of a portion of the resorcinol solution (62 grams) all at once. The resulting suspension was then transferred into a 2 liter reaction kettle equipped with mechanical stirrer and condenser. After 10 minutes of stirring, a monophenolate solution (30 grams, same as that of Example I) was added. Stirring was continued for 50 minutes, 2 percent Pluronic F38 (400 grams) added and the entire mixture was heated at 75° C. for 15 hours and then at 85° C. for 5 hours, and then transferred into a 4 liter beaker. The resulting toner particles comprised of a core containing the passivated pink pigment, styrene-butyl methacrylate polymer and a shell of a copolyester with t-butyl phenyl chain ends. The particles were washed with water (3 liters×20), sieved through a combination of 425 and 250 micron sieves, and spray dried to provide the above toner (115 grams, 60 percent) with an average particle diameter size of 15 microns, and GSD of 1.8 as determined by a Coulter Counter.

EXAMPLE V

A pigment dispersion of the following composition was prepared by repeating the process of Example I; specifically, DuPont Elvacite pigment dispersant AB 1020 (3 grams), styrene (50 grams), BMA (50 grams), a 60/40 solution of a styrene-butyl methacrylate polymer in styrene (50 grams), predispersed Hostaperm Pink E (35 grams), isophthaloyl chloride (20 grams), AIBN (1 gram), and VAZO 52 (1 gram). A solution of bisphenol A was prepared according to the following procedure. Potassium hydroxide (14.5 grams) was added into a 250 milliliter PP bottle containing ice water (200 grams). After KOH was solubilized, bisphenol A (25 grams), and $K_2CO_3$ (20 grams) were added. The resulting mixture was shaken to provide a bisphenol solution. An emulsifier solution having 4 percent Pluronic F108 and 0.4 percent PVA (MW=3,000, 75 percent hydrolyzed) was also prepared. The pigment dispersion (91 grams) was added to a homogenizing emulsifier solution (600 grams with 0.65 gram of BTEAC added), and homogenization probe, speed, and duration were 36/2G, 7,000 rpm, and 10 seconds, respectively, to provide an o/w suspension. This suspension was transferred into a 2 liter reaction kettle and was stirred mechanically. A portion of the above bisphenol A solution (35 grams) was then added. The resulting mixture was stirred for 10 minutes and an additional bisphenol A solution (13 grams) was added to the aforementioned mixture. The resulting mixture was stirred at room temperature for 2 hours. A protective colloid solution (900 grams containing 18 grams of Pluronic F 38 and 15 grams of KI) was added. The mixture was then heated at 70° to 75° C. for 7 hours and then at 85° C. for 10 hours. The mixture was transferred into a 4 liter beaker and washed with water (3 liters×10), sieved through a combination of 425 and 250 micron sieves and spray dried to provide a toner comprised of the core and shell components of Example II (58 grams, 60 percent) with an average particle size of 16 μm and a GSD of 1.8.

EXAMPLE VI

An attrited pigment concentrate containing 15 percent of Hostaperm Pink E, 6 percent of a pigment dispersant, and 79 percent of BMA, provided by E. I. DuPont, was used to prepare a pigment dispersion and a toner by substantially repeating the procedure of Example I. The concentrate (100 grams), butyl methacrylate (23 grams) and a 50/50 solution of a styrene-butyl methacrylate polymer in styrene (100 grams) was shaken for 5 hours. Isophthaloyl chloride (13 grams), AIBN (1 gram), and VAZO 52 (1 gram) were then added. A solution of bisphenol A was also prepared according to the following procedure. Sodium hydroxide (8.8 grams) was added into a 150 milliliter PP bottle containing ice water (100 grams). After the KOH had been solubilized, bisphenol A (15 grams) and $K_2CO_3$ (10 grams) were added. The mixture was shaken until a solution was obtained. An emulsifier solution having 4 percent Pluronic F108 and 0.4 percent PVA (MW=96,000, 88 percent hydrolyzed) was also prepared. A portion of the pigment dispersion (95 grams) was added to a homogenizing emulsifier solution with 4 percent Pluronic and 0.4 percent PVA (MW=96,000; 88 percent hydrolyzed) (500 grams containing 10 grams of KI), homogenization probe, speed, and duration were 35/4G, 8,000 rpm, and 30 seconds, respectively, to yield an o/w suspension. This suspension was transferred into a 2 liter reaction kettle and was stirred mechanically. A portion of the above bisphenol A solution (52 grams) was then added to the aforementioned solution. The mixture was stirred for 10 minutes and a solution of t-butylphenol (15 grams, prepared from 5 grams of t-butyl phenol, 2.5 grams of KOH and 22.5 grams of water) was added thereto. The resulting mixture was stirred at room temperature for 1 hour. A protective colloid solution (1,000 grams containing 20 grams of Pluronic F38 and '0 grams of KI) was added. The mixture was then heated at 75° C. for 20 hours and then at 85° C. for 4 hours. The resulting mixture was transferred into a 4 liter beaker and washed with water (3 liters×10), sieved through a combination of 425 and 250 micron sieves and spray dried to provide a toner comprised of the core and shell components of Example I (40 grams, 60 percent) with an average diameter particle size of 13.6 μm (microns) and a GSD of 1.8. As determined by a transmission electron microscope, the shell thickness was 0.1 to 0.4 micron, and the pigment particles were evenly dispersed within the core.

EXAMPLE VII

An attrited pigment concentrate consisting of 30 percent of Novoperm Yellow FGL, 5 percent of a block polymer pigment dispersant, and 65 percent of BMA, provided by DuPont, was used to prepare the pigment dispersion by substantially repeating the procedure of Example I, and wherein a polyester shell was selected. The concentrate (100 grams), a 60/40 solution of a styrene-butyl methacrylate polymer in styrene (100 grams) and butyl methacrylate (23 grams) was shaken for 5 hours. Isophthaloyl chloride (12 grams), AIBN (1 gram), and VAZO 52 (1 gram) were then added and the resulting mixture was shaken for another 30 minutes to provide a pigment dispersion (227 grams total weight). A portion of the prepared pigment dispersion (100 grams) was added to a homogenizing emulsifier solution having 4 percent Pluronic and 0.4 percent PVA (MW=96,000; 88 percent hydrolyzed) (500 grams containing 10 grams of KI). The homogenization probe, speed, and duration were 35/4G, 8,000 rpm, and 30 seconds, respectively. An o/w suspension resulted. To this o/w was added the bisphenol A solution (49 grams of Example VI) with stirring. The resulting suspension was transferred into a 2 liter reaction kettle and was stirred mechanically. After stirring for 10 minutes, the solution of t-butylphenol (15 grams prepared from 5 grams of t-butyl phenol, 2.5 grams of KOH and 22.5 grams of water) was added. The resulting mixture was stirred at room temperature for 1 hour. A protective colloid solution (1,000 grams containing 20 grams of Pluronic F38 and 10 grams of KI) was added to the aforementioned mixture. The resulting mixture was then heated at 75° C. for 18 hours and then at 85° C. for 6 hours. The toner product mixture was transferred into a 4 liter beaker and washed with water (3 liters×10), sieved through a combination of 425 and 250 micron sieves and spray dried to provide a toner (65 grams, 62 percent) comprised of a core containing the yellow pigment, and the copolymer of styrene and butyl methacrylate, and the polyester shell of Example I. The toner average particle diameter size was 17.8 microns with a GSD of 1.5. According to transmission electron microscope, the shell thickness was 0.1 to 0.4 micron and the pigment particles were evenly dispersed within the core. Fused solid images upon paper were obtained from the toner sample with a hard silicone fuser roll running at 3 inches per second at 300° to 345° F. with substantially no toner offsetting.

EXAMPLE VIII

The yellow pigment concentrate of Example VII (100 grams) was mixed with a 60/40 solution of a styrene-butyl methacrylate polymer in styrene (100 grams) and butyl methacrylate (23 grams) for 5 hours with a shaker, reference Example VII. Isophthaloyl chloride (14 grams), AIBN (1 gram), VAZO 52 (1 gram) were then added and the resulting mixture was shaken for another 30 minutes to yield a pigment dispersion (229 grams total weight). A portion of the yellow pigment dispersion, 100 grams, was added to a homogenizing emulsifier solution having 4 percent Pluronic and 0.4 percent PVA (MW=96,000; 88 percent hydrolyzed) (500 grams, containing 10 grams of KI). The homogenization probe, speed, and duration were 35/4G, 8,000 rpm, and 30 seconds, respectively. There resulted an o/w suspension. To this o/w was added the bisphenol A solution (56 grams of Example VI) with stirring. The resulting suspension was transferred into a 2 liter reaction kettle and was stirred mechanically. After stirring for 10 minutes, the solution of t-butylphenol (15 grams prepared from 5 grams of t-butyl phenol, 2.5 grams of KOH and 22.5 grams of water) was added to the suspension. The resulting mixture was stirred at room temperature for 1 hour. A protective colloid solution (1,000 grams containing 20 grams of Pluronic F38 and 10 grams of KI) was added. The mixture was then heated at 75° C. for 18 hours and then at 85° C. for 6 hours. The product mixture was transferred into a 4 liter beaker and washed with water (3 liters×10), sieved through a combination of 425 and 250 micron sieves and spray dried to yield a toner comprised of the core and shell components of Example I (64 grams, 62 percent) with an average particle diameter size of 11.6 μm and GSD of 1.7. This toner also fused at 300° to 345° F. with a hard silicone fuser roll running at 3 inches per second.

EXAMPLE IX

The yellow pigment concentate of Example VIII (100 grams), a 60/40 solution of a styrene-butyl methacrylate polymer in styrene (100 grams) and butyl methacrylate (23 grams) were shaken for 5 hours. Isophthaloyl chloride (14 grams), benzene tricarboxylic acid chloride (1 gram), AIBN (1 gram), and VAZO 52 (1 gram) were then added and shaken for 30 minutes to yield a pigment dispersion (230 grams total weight). A portion of the pigment dispersion (100 grams) was added to a homogenizing emulsifier solution containing 4 percent Pluronic and 0.4 percent PVA (MW=96,000; 88 percent hydrolyzed) (500 grams containing 10 grams of KI). The homogenization probe, speed, and duration were 35/4G, 8,000 rpm, and 30 seconds, respectively. There resulted an o/w suspension. To this suspension was added the bisphenol A solution (58 grams of Example VI) all at once with stirring. The resulting suspension was transferred into a 2 liter reaction kettle and was stirred mechanically. After stirring for 10 minutes, the solution of t-butylphenol (15 grams prepared from 5 grams of t-butyl phenol, 2.5 grams of KOH and 22.5 grams of water) was added to the aforementioned suspension. The resulting mixture was stirred at room temperature for 1 hour. A protective colloid solution (1,000 grams containing 20 grams of Pluronic F38 and 10 grams of KI) was added. The mixture was then heated at 75° C. for 18 hours and then at 85° C. for 6 hours. The product mixture was transferred into a 4 liter beaker and washed with water (3 liters×10), sieved through a combination of 425 and 250 micron sieves and spray dried to provide a toner comprised of a core containing the passivated pink pigment, styrene-butyl methacrylate polymer and a shell of a branched copolyester with t-butyl phenyl chain ends (62 grams, 60 percent) with an average particle diameter size of 12.6 μm and GSD of 1.8. This toner also fused at 300° to 345° F. with a hard silicone fuser roll running at 3 inches per second.

Other modifications of the present invention may occur to those skilled in the art, subsequent to a review of the present application. These modifications, including equivalents thereof, are intended to be included within the scope of the present invention.

What is claimed is:

1. A toner composition comprised of a core comprised of pigments, dyes or mixtures thereof, and a polymer; and wherein the core is encapsulated in a telechelic polyester shell obtained by reacting a polyester with acid halide terminating groups thereon with a mono, di, or polyfunctional nucleophile, whereby the acid halide terminating groups of the polyester react with said nucleophile.

2. A toner in accordance with claim 1 wherein the polyester shell is derived from telechelic polyesters.

3. A toner in accordance with claim 1 wherein the core polymer is comprised of a styrene acrylate, a styrene methacrylate, or a styrene butadiene.

4. A toner in accordance with claim 1 wherein the core polymer is derived from the polymerization of an acryloxy-, a methacryloxy-, or a styryl-functionalized polysiloxane and an acrylate, a methacrylate, a styryl, or other vinyl-functionalized monomer.

5. A toner in accordance with claim 1 wherein the pigment is carbon black, iron oxides, magnetites, or mixtures thereof.

6. A toner in accordance with claim 5 wherein the pigment selected is comprised of surface treated magnetite.

7. A toner in accordance with claim 1 wherein the pigment is cyan, yellow, magenta, red, green, blue, brown, or mixtures thereof.

8. A toner in accordance with claim 7 wherein the pigment or dye is selected from the group consisting of Heliogen Blue, Pylam Oil Blue, Pylam Oil Yellow, Pigment Blue, Pigment Violet, Pigment Red, Lemon Chrome Yellow, Toluidine Red, Bon Red, NOVAperm Yellow FGL, Hostaperm Pink E, Cinquasia Magenta, Oil Red, 2,9-dimethyl-substituted quinacridone, Dispersed Red, diazo dye, Solvent Red, copper tetra-4-(octadecyl sulfonamido) phthalocyanine, X-copper phthalocyanine, Anthrathrene Blue, diarylide yellow 3,3-dichlorobenzidene acetoacetanilides, Solvent Yellow, nitrophenyl amine sulfonamide, 2,5-dimethoxy-4-sulfonanilide phenylazo-4'-chloro-2,5-dimethoxy acetoacetanilide, and Permanent Yellow FGL.

9. A toner in accordance with claim 1 wherein the shell represents from about 5 to 30 percent by weight of the toner, the core binder polymer represents from about 20 to about 90 percent by weight of the toner, and the pigment represents from about 2 to about 75 percent by weight of toner.

10. A toner in accordance with claim 1 containing surface additives comprised of metal salts, metal salts of fatty acids, or colloidal silicas.

11. A toner in accordance with claim 10 wherein zinc stearate is selected.

12. A toner in accordance with claim 11 wherein the additives are present in an amount of from about 0.1 to about 5.0 weight percent.

13. A toner in accordance with claim 1 wherein the toner shell is prepared by interfacial polymerization.

14. A toner in accordance with claim 1 wherein the shell surface is coated with conductive components.

15. A toner in accordance with claim 14 wherein the conductive components are comprised of carbon blacks, graphite, or mixtures thereof.

16. A toner in accordance with claim 1 wherein the core monomers for the formation of the core polymer is selected from the group consisting of n-butyl acrylate, s-butyl acrylate, isobutyl acrylate, n-butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, dodecyl styrene, hexylmethyl styrene, nonyl styrene, and tetradecyl styrene.

17. A toner composition in accordance with claim 1 wherein the diacid halide is a diacid chloride.

18. A toner composition in accordance with claim 1 wherein there results a linear, block, or branched polyester.

19. A process for the preparation of encapsulated toners which comprises preparing a mixture containing at least one core monomer, pigment, dye or mixtures thereof, radical initiators and a diacid halide monomer; dispersing the mixture into a emulsifier solution; adding to the resulting oil-in-water suspension a solution of bisphenolate and a catalyst thereby forming an acid halide terminated shell prepolymer through interfacial polymerization; subsequently adding to the suspension nucleophilic monomers capable of reacting with the terminal acid halide groups to form a polyester shell with functional groups thereon, which shell encapsulates the core components.

20. A process for the preparation of encapsulated toner compositions comprised of a core component and a shell component derived from a reactive polyester, which process comprises (1) providing a pigment dispersion comprised of at least one monomer capable of being polymerized by free radical polymerization, pigment, dye or mixtures thereof, and a free radical initiator, a polymer and an oil soluble shell monomer or monomers; (2) dispersing the aforementioned dispersion in an aqueous phase containing an emulsifier, an optional surfactant, an optional antifoaming agent, and an optional phase transfer catalyst; (3) adding less than a stoichiometric amount of a water soluble shell monomer to initiate the first stage of interfacial polymerization thereof; (4) adding a neucleophile to react with the aforementioned shell monomer thereof completing the formation of the shell; (5) heating the aqueous suspension of the encapsulated particles thereby effecting in situ polymerization of the core monomers; (6) washing the resulting toner product with deionized water; and (7) drying the washed toner product.

21. A process in accordance with claim 20 wherein the reactive polyester shell is derived from diacid halides.

22. A process in accordance with claim 21 wherein the diacid halides are comprised of diacid chlorides.

23. A process for the preparation of encapsulated toners which comprises preparing a pigment mixture containing core monomers, pigments, dyes or mixtures thereof, free radical initiators and diacid halide shell monomers; dispersing the mixture in an aqueous solution containing emulsifiers and a phase transfer catalyst; adding to the resulting suspension a bisphenolate solution, which was prepared by dissolving bisphenol in an aqueous sodium or potassium hydroxide solution, whereby the bisphenolate and diacid halide react to form an acid halide terminated reactive polyester, and subsequently adding to the solution nucleophilic monomers capable of reacting with the diacid halide terminated polyesters, thereby resulting in formation by interfacial polymerization of a modified polyester shell component surrounding the core components.

24. A process in accordance with claim 23 wherein the nucleophilic monomers are selected from the group consisting of amines, phenolates, thiophenolates, and mixtures thereof.

25. A process in accordance with claim 23 wherein the weight average molecular weight of the polyester shell is from about 5,000 to about 200,000.

26. A process for the preparation encapsulated toners which comprises (1) adding about 5 to 30 parts of a prepolymer and 10 to 30 parts of a predispersed magenta pigment powder into about 30 to 50 parts of a solution of vinyl core monomers; (2) mixing the aforementioned mixture with a mechanical shaker or a roll mill; (3) adding about 5 to 15 parts of an oil soluble first shell monomer or monomers and about 1 to 5 parts of free radical initiator or initiators to the mixture; (4) mixing the shell monomer(s) and the initiator(s) to provide a pigment dispersion comprised of the aforementioned components; (5) dispersing about 10 to 20 parts of the resulting dispersion into 50 to 200 parts of an aqueous emulsifier solution to provide an oil-in-water suspension; (6) adding to the suspension an aqueous solution of a second shell monomer or monomers at a molar ratio of about 0.9 to 1.0 with respect to the first shell monomer(s) to initiate interfacial polymerization and to form reactive polyester shells; (7) allowing the suspension to stir; (8) adding to the resulting suspension about 0.1 to 0.5 parts of a neucleophile; (9) adding to the resulting suspension from about 0.1 to 100 parts of an aqueous protective colloid solution; (10) heating the resulting suspension to accomplish free radical suspension polymerization of the core monomer or core monomers; (11) washing the resulting encapsulated toner particles; (12) sieving the washed toner particles and (14) thereafter drying the toner particles.

27. An encapsulated toner composition comprised of the particles obtained by the process of claim 26, and pigment or dye particles.

28. A toner composition in accordance with claim 27 wherein the pigment particles are selected from the group consisting of carbon black, magnetites, cyan, magenta, yellow, red, blue, green, brown, and mixtures thereof.

29. A toner composition in accordance with claim 1 wherein at least one monomer is selected for the polymer core.

30. A toner composition in accordance with claim 1 wherein from 2 to about 20 monomers are selected.

31. A toner comprised of a core comprised of at least one polymer, and pigment, dye or mixtures thereof; and wherein the core is encapsulated in a polyester shell obtained from a diacid halide terminated polyester component obtained by reacting a polyester with acid halide terminating groups thereon with a mono, di, or polyfunctional nucleophile.

32. A toner in accordance with claim 31 wherein from about 2 to about 10 polymers are present.

33. A toner composition comprised of a core comprised of pigments and a polymer, and wherein the core is encapsulated in a polyester shell obtained by reacting a polyester with acid halide terminating groups thereon with a mono, di, or polyfunctional nucleophile.

34. An encapsulated toner in accordance with claim 1 wherein the polyester is formed by the reaction of a bisphenol and a diacid halide to form an acid halide terminated reactive polyester, subsequently adding a nucleophilic monomer capable of reacting with a diacide halide terminated polyester thereby resulting in formation by interfacial polymerization of a modified polyester shell.

35. An encapsulated toner in accordance with claim 33 wherein the nucleophile is comprised of amino, phenolic or thiophenolic compounds.

36. An encapsulated toner composition comprised of a core comprised of pigment particles and a polymer; wherein the core is encapsulated in a telechelic polyester shell, which shell is obtained by the reaction of a diacid halide with a polyhydroxy compound thereby resulting in a polyester shell with diacid halide terminating groups thereon; subsequently reacting the resulting polyester with a mono, di, or polyfunctional nucleophile resulting in a final polyester shell whereby the acid halide groups of the polyester have been reacted with said nucleophile.

37. An encapsulated toner in accordance with claim 36 wherein the nucleophile is selected from the group consisting of butylaniline, phenylaniline, chloroaniline, trifluoromethylaniline, butoxyaniline, aminobenzonitrile, bis(trifluoromethyl)aniline, aminophenyl, sodium or potassium aminoethane sulfonate, sodium aminonaphthalenesulfonate or potassium aminonaphthalenesulfonate, sodium aminobenzoate or potassium aminobenzoate, and butyl thiophenol.

38. An encapsulated toner in accordance with claim 1 wherein the nucleophile is selected from the group consisting of butylaniline, phenylaniline, chloroaniline, trifluoromethylaniline, butoxyaniline, aminobenzonitrile, bis(trifluoromethyl)aniline, aminophenyl, sodium or potassium aminoethane sulfonate, sodium or potassium aminonaphthalenesulfonate, sodium or potassium aminobenzoate, and butyl thiophenol.

* * * * *